United States Patent [19]

Ghibu et al.

[11] Patent Number: 4,570,748

[45] Date of Patent: Feb. 18, 1986

[54] CO-OSCILLATING, VOLUME-CHANGING RESONATOR IN THE FORM OF A SILENCER

[75] Inventors: Michael Ghibu, Puchheim; Volker Härtel, Germering; Carl Heynemann, Taufkirchen; Manfred Raubach, Olching, all of Fed. Rep. of Germany

[73] Assignee: Metzeler Kautschuk GmbH, Munich, Fed. Rep. of Germany

[21] Appl. No.: 608,778

[22] Filed: May 10, 1984

[30] Foreign Application Priority Data

May 10, 1983 [DE] Fed. Rep. of Germany ..... 3317103

[51] Int. Cl.[4] ..... E04B 1/82

[52] U.S. Cl. ..... 181/286; 181/288; 181/291; 181/294; 181/295

[58] Field of Search ..... 181/284–292, 181/295, 294, 282

[56] References Cited

U.S. PATENT DOCUMENTS

| | | | |
|---|---|---|---|
| 2,502,020 | 3/1950 | Olson | 181/295 |
| 3,782,495 | 1/1974 | Wassof | 181/291 X |
| 3,895,143 | 7/1975 | Tarlow | 181/294 X |
| 4,228,869 | 10/1980 | Bschorr | 181/295 X |
| 4,325,461 | 4/1982 | Bschorr | 181/286 |
| 4,340,129 | 7/1982 | Salyers | 181/291 X |

*Primary Examiner*—Benjamin R. Fuller

*Attorney, Agent, or Firm*—Herbert L. Lerner; Laurence A. Greenberg

[57] ABSTRACT

A co-oscillating, volume-changing resonator in the form of a silencer, includes a lens-shaped housing formed of a material having a given flexural stiffness, the housing being arched defining an evacuated cup-shaped cavity formed therein, and a coating layer completely surrounding the housing, the coating layer being formed of a material having a flexural stiffness being at most one-third of the given flexural stiffness of the material of the housing.

5 Claims, 4 Drawing Figures

CO-OSCILLATING, VOLUME-CHANGING RESONATOR IN THE FORM OF A SILENCER

The invention relates to a co-oscillating, volume-changing resonator in the form of a silencer (silator) having a lens-shaped housing being arched defining an evacuated cup-shaped cavity formed therein.

A resonator of this type is disclosed, for example, in German Published, Prosecuted, Application Nos. DE-AS 28 34 823, DE-AS 26 32 290 and DE-AS 29 47 026. The resonator has a lens-shaped, arched housing, usually made of sheet steel, with an evacuated inner hollow space. Instead of sheet steel, other materials may also be used, such as aluminum or synthetics.

Such resonators are used for noise-damping in air and other gaseous, vaporous or fluid media, wherein the lens-shaped housing is caused to oscillate by the sound vibrations, to absorb the sound vibrations, and to reduce the sound level.

The maximum absorption of the sound vibration is obtained in the range of the characteristic or inherent frequency of the silencer, which is essentially a function of the wall thickness, the height of the arch, and the diameter of the lens-shaped housing, as discussed in German Published, Prosecuted, Application No. DE-AS 29 47 026.

The practical result of these physical limitations and consideration of these parameters is that only silencers with a characteristic frequency of about 600 Hz can be manufactured. However, there are many applications where lower frequencies have to be damped; for example, the damping of the engine noise of a motor vehicle, wherein it is required to damp sound vibrations with frequencies in the range between 100 and 300 Hz. This is not possible with silencers available heretofore.

It is accordingly an object of the invention to provide a co-oscillating, volume-changing resonator in the form of a silencer, which overcomes the hereinafore-mentioned disadvantages of the heretofore-known devices of this general type.

In particular, a resonator is proposed which can also dampen sound vibrations with an extremely low frequency range of about 100 to 400 Hz.

With the foregoing and other objects in view there is provided, in accordance with the invention, a co-oscillating, co-vibrating or resonant volume-changing resonator in the form of a silencer (silator) comprising a lens-shaped housing formed of a material having a given flexural stiffness, the housing being arched defining an evacuated cup-shaped or spherical cavity formed therein, and a coating layer completely surrounding the housing, the coating layer being formed of a material having a flexural stiffness being at most one-third of the given flexural stiffness of the material of the housing.

In accordance with another feature of the invention, the material of the coating layer has a specific weight of 0.8 to 5 g/cm$^3$ or 1 to 3.5 g/cm$^3$.

In accordance with a further feature of the invention, the material of the coating layer has a Shore-A-Hardness of less than 50. Shore-A-Hardness is the measurement of resistance for hardness of soft rubber against the penetration of the frustrum of a cone. Measured on an arbitrary unitless scale from 0 to 100 (see the standard test method of rubber property).

In accordance with an added feature of the invention, the material of the coating layer is an elastomer.

In accordance with an additional feature of the invention, the material of the coating layer is an elastomer containing a filler substance having a specific weight greater than 2 g/cm$^3$.

In accordance with again another feature of the invention, the filler substance is metallic.

In accordance with again a further feature of the invention, the filler substance is lead sulfide or red lead.

In accordance with again an added feature of the invention, the coating layer is a thin metal layer.

In accordance with again an additional feature of the invention, the coating layer is a thin layer formed of a metal or an alloy of a metal from the group consisting of lead, antimony and tin.

In accordance with yet another feature of the invention, the housing has an outer edge region and the coating layer is connected to the housing exclusively at the outer edge region defining a space between the coating layer and the housing, and including fluid filling the space having a specific weight greater than 0.8 g/cm$^3$ or 1.0 g/cm$^3$.

In accordance with yet a further feature of the invention, the fluid is water or oil having additives formed of substances with a high specific weight.

In accordance with yet an added feature of the invention, the coating layer has holes formed therein.

In accordance with a concomitant feature of the invention, there is provided an additional absorption layer disposed on the coating layer and formed of a soft, light, elastomer material.

The advantages achieved by practicing the invention are based on the experimentally proven idea of providing the housing of the silencer with a coating layer made of a material with extremely low flexural stiffness, and of therefore shifting the characteristic frequency of the silencer to lower frequency values.

A very soft elastomer material is very suitable to be used as this layer, especially rubber to which heavy filler substances have been added, in order to increase the specific weight of the coating layer, and to thus achieve additional sound damping.

As an alternative version, it is also possible to provide the housing with a cover layer of a metal with very low flexural stiffness. For this purpose, lead, antimony or tin are especially useful. The advantage of this embodiment lies in the fact that with the use of a very thin coating layer, the device is more resistant to high temperature and corrosion.

Other features which are considered as characteristic for the invention are set forth in the appended claims.

Although the invention is illustrated and described herein as embodied in a co-oscillating, volume-changing resonator in the form of a silencer, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
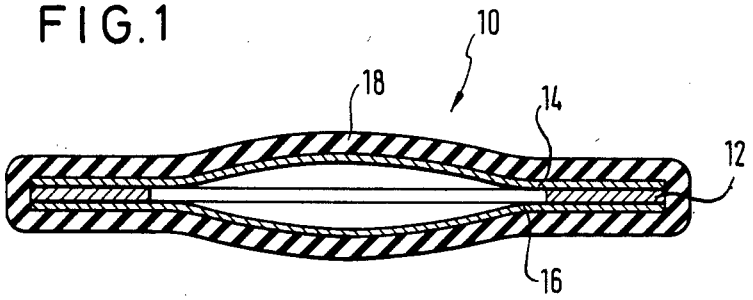
FIG. 1 is a cross-sectional view of a first embodiment of a silencer or sound damper or absorber.

Referring now to the figures of the drawing in detail and first particularly to FIG. 1 thereof, there is seen a silencer (silator) which is designated as a whole with reference number 10. The silencer contains an intermediate plate 12 which may be rectangular or square, having a circular opening formed in the center thereof. Two thin plates 14 and 16 which bulge outwardly like a lens and form the housing of the silencer 10, are connected to edge regions of the intermediate plate 12. The hollow interior of the housing is evacuated.

The entire outer surface of the silencer 10 is surrounded by a layer 18 made of a soft elastomer, elastic or flexible material, such as rubber, having a flexural stiffness which is at most one-third of the flexural stiffness of the material forming the two plates 14, 16. The Shore-A-Hardness of the elastic material should be less than 50.

Good results are achieved if the elastomer material has a specific weight of 1 to 3.5 g/cm$^3$; in order to give this rubber-like material this specific weight, a filler with a specific weight of more than 2 g/cm$^3$, such as lead sulfide or red lead, is added.

Figure 4:
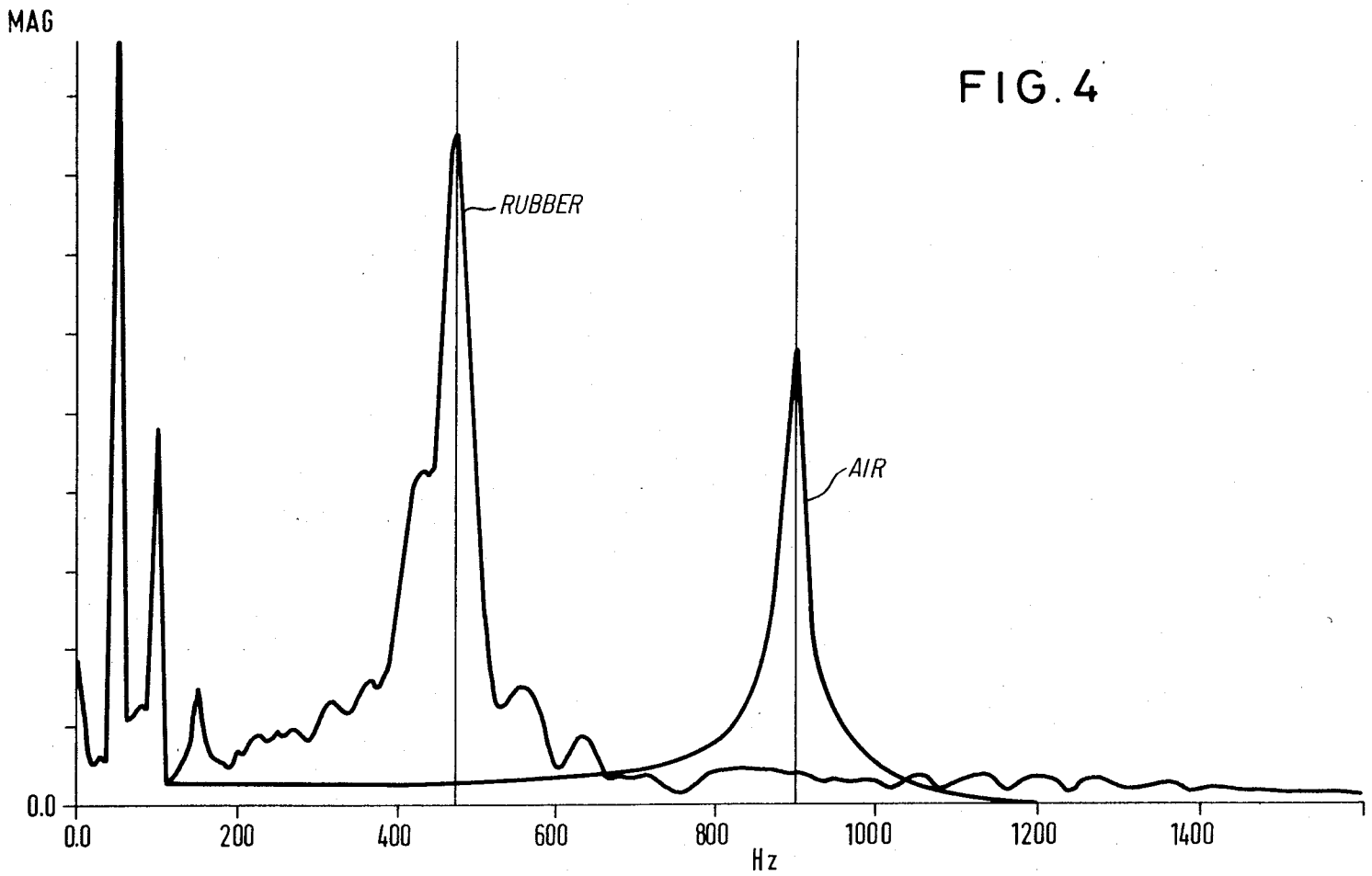
FIG. 4 is a graph of the characteristic frequency of a conventional silencer oscillating in air, and of a silencer which is provided with a coating made of a soft rubber.

FIG. 4 shows the resonance spectrum of a silencer vibrating in air, which is constructed substantially like the device shown in FIG. 1, but without the coating 18. The diagram shows that the fundamental or characteristic frequency of this silencer lies approximately at 900 Hz. This value can be somewhat reduced by certain structural measures, such as influencing the wall stiffness, the height of the arch or bulge, and the diameter of the lens-shaped housing; however, even with all of these measures, a lower limit of about 600 Hz can not be achieved.

Additionally, FIG. 4 also shows the resonance spectrum of the silencer according to FIG. 1, i.e. of a conventional silencer which is provided with a coating 18 made of a soft rubber with a filler material. The diagram shows that the inherent or characteristic frequency has been reduced to less than 500 Hz. By providing a corresponding construction of the mechanical properties and the property of the coating 18, characteristic or fundamental frequencies between 100 and 300 Hz can be obtained, as is required for damping the noise level of motor vehicles.

Figure 2:
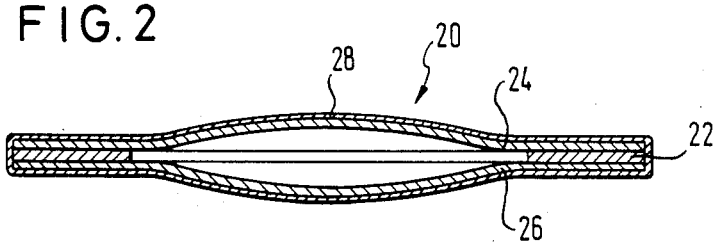
FIG. 2 is a cross-sectional view of a second embodiment of the silencer.

FIG. 2 illustrates an embodiment of a silencer 20 with an intermediate plate 22 and two lens-shaped arched housing plates 24 and 26, which is surrounded by a thin metal layer 28. Lead, antimony or tin may be used for this purpose. The advantage of this construction is that the device is more resistant to high temperatures and corrosion than a similar device coated with an elastomer material.

Figure 3:
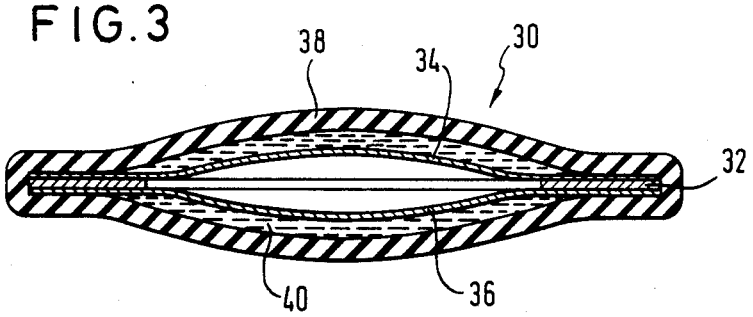
FIG. 3 is a cross-sectional view of a third embodiment of a silencer.

Finally, FIG. 3 shows a variation of the embodiment according to FIG. 1, i.e. a silencer 30 with an intermediate plate 32, and lens-shaped arched housing plates 34 and 36. In this case a coating 38 of elastomer material with the above-mentioned filler substances is only connected to the housing plates 34 and 36 at edge regions of the intermediate plate 32. The space which is thus created between the lens-shaped arched housing plates 34, 36 and the coating 38 is filled by a fluid layer 40, such as water or oil. This measure permits the characteristic frequency of the silencer 30 to be lowered even further to frequencies required for applications wherein sound vibrations in the range of 50 to 150 Hz have to be damped or absorbed.

In order to make the thickness of the fluid layer 40 as small as possible, a fluid with a specific weight of at least 1 g/cm$^3$ should be used. For this purpose, substances with a high specific weight may be added to the fluid which is water or oil.

Experiments performed with the silencer according to FIG. 1 have shown that besides a shift of the characteristic frequency as shown in FIG. 4, the degree of absorption is also reduced by a factor of about 10. A prototype of a silencer according to FIG. 1, without the coating 18, was found to have a degree of absorption of about 4 percent at a resonant or mutual frequency of about 900 Hz., and with a coating of soft rubber, it was found to have a degree of absorption of about 40 percent, at a resonant or natural frequency of about 400 Hz. The rubber used has an absorption-degree of about 10 percent at a resonant frequency of about 400 Hz.

A further improvement of sound damping can be achieved by providing the coating layer 18, 28, with holes. Combinations of layers could also be used. For example, an additional thin absorption layer made of a soft, light elastomer material can also be applied to improve the absorption even further. For example, a thin layer of foam material could be used.

The foregoing is a description corresponding in substance to German Application No. P 33 17 103.3, filed May 10, 1983, the International priority of which is being claimed for the instant application, and which is hereby made part of this application. Any discrepancies between the foregoing specification and the aforementioned corresponding German application are to be resolved in favor of the latter.

We claim:

1. Co-oscillating, volume-changing resonator in the form of a silencer, comprising a lens-shaped housing formed of arched plates defining an evacuated cup-shaped cavity formed therein, and means for lowering the frequency of sound waves, said frequency reducing means being in the form of a coating layer completely surrounding said housing, said coating layer having a specific weight of 1 to 3.5 g/cm$^3$, and said coating layer being formed of an elastomer material with a Shore-A-Hardness less than 50 and a filler substance with a high specific weight as compared to said elastomer material.

2. Resonator according to claim 1, wherein said filler substance has a specific weight greater than 2 g/cm$^3$.

3. Resonator according to claim 2, wherein said filler substance is metallic.

4. Resonator according to claim 3, wherein said filler substance is lead sulfide.

5. Resonator according to claim 3, wherein said filler substance is red lead oxide.

* * * * *